US012313303B2

(12) United States Patent
Shin et al.

(10) Patent No.: US 12,313,303 B2
(45) Date of Patent: May 27, 2025

(54) AIR CONDITIONER

(71) Applicant: LG ELECTRONICS INC., Seoul (KR)

(72) Inventors: Ilyoong Shin, Seoul (KR); Yongcheol Sa, Seoul (KR); Chiwoo Song, Seoul (KR); Kakjoong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 265 days.

(21) Appl. No.: 17/797,428

(22) PCT Filed: Nov. 13, 2020

(86) PCT No.: PCT/KR2020/016031
§ 371 (c)(1),
(2) Date: Aug. 4, 2022

(87) PCT Pub. No.: WO2021/157820
PCT Pub. Date: Aug. 12, 2021

(65) Prior Publication Data

US 2023/0074034 A1 Mar. 9, 2023

(30) Foreign Application Priority Data

Feb. 6, 2020 (KR) ..... 10-2020-0014462

(51) Int. Cl.
*F25B 13/00* (2006.01)
*F25B 31/00* (2006.01)
*F25B 47/02* (2006.01)

(52) U.S. Cl.
CPC ..... *F25B 13/00* (2013.01); *F25B 31/004* (2013.01); *F25B 47/022* (2013.01);
(Continued)

(58) Field of Classification Search
CPC ..... F25B 2400/19; F25B 2313/02322; F25B 2313/023; F25B 41/40; F25B 41/20;
(Continued)

(56) References Cited

U.S. PATENT DOCUMENTS

2012/0118005 A1* 5/2012 Yamashita ..... F25B 25/005 62/513
2012/0198873 A1 8/2012 Yamashita et al.
(Continued)

FOREIGN PATENT DOCUMENTS

CN 1818498 8/2006
CN 104792075 7/2015
(Continued)

OTHER PUBLICATIONS

Chinese Office Action dated Apr. 14, 2023 issued in Application No. 202080095378.8.
(Continued)

*Primary Examiner* — Ana M Vazquez
(74) *Attorney, Agent, or Firm* — KED & ASSOCIATES, LLP

(57) ABSTRACT

An air conditioner includes an outdoor unit in which refrigerant circulates; an indoor unit in which water circulates; a heat exchange device including a heat exchanger connecting the outdoor unit to the indoor unit and performing heat exchange between the refrigerant and the water; a first outdoor unit connection pipe connecting the outdoor unit and the heat exchange device, a high-pressure gaseous refrigerant flowing in the first outdoor unit connection pipe; a second outdoor unit connection pipe connecting the outdoor unit and the heat exchange device, a low-pressure gaseous refrigerant flowing in the second outdoor unit connection pipe; a third outdoor unit connection pipe connecting the outdoor unit and the heat exchange device, a
(Continued)

liquid refrigerant flowing in the third outdoor unit connection pipe; a bypass pipe communicating the third outdoor unit connection pipe and the second outdoor unit connection pipe; and a bypass valve provided in the bypass pipe.

18 Claims, 5 Drawing Sheets

(52) U.S. Cl.
CPC ... *F25B 2313/003* (2013.01); *F25B 2313/007* (2013.01); *F25B 2313/0253* (2013.01); *F25B 2600/2501* (2013.01); *F25B 2600/2513* (2013.01); *F25B 2700/2103* (2013.01)

(58) Field of Classification Search
CPC ..... F25B 49/02; F25B 25/005; F25B 2600/2501; F25B 2313/007
See application file for complete search history.

(56) References Cited

U.S. PATENT DOCUMENTS

| | | | |
|---|---|---|---|
| 2012/0291460 | A1 | 11/2012 | Aoyagi |
| 2015/0308700 | A1 | 10/2015 | Kimura et al. |
| 2016/0116202 | A1 | 4/2016 | Takenaka et al. |
| 2016/0238290 | A1 | 8/2016 | Bae et al. |
| 2019/0346189 | A1 | 11/2019 | Saito et al. |

FOREIGN PATENT DOCUMENTS

| | | |
|---|---|---|
| CN | 106196524 | 12/2016 |
| JP | 2004-205200 | 7/2004 |
| JP | 2008-116073 | 5/2008 |
| JP | 2013-044512 | 3/2013 |
| JP | 5279919 | 5/2013 |
| JP | 2014-088965 | 5/2014 |
| JP | 5968534 | 8/2016 |
| JP | 2017-101855 | 6/2017 |
| JP | 2019-143876 | 8/2019 |
| KR | 10-2009-0099611 | 9/2009 |
| KR | 10-0997284 | 11/2010 |
| KR | 10-2014-0139240 | 12/2014 |
| WO | WO 2006/115053 | 11/2006 |
| WO | WO 2011/092802 | 8/2011 |
| WO | WO 2012/070082 | 5/2012 |
| WO | WO 2014/091548 | 6/2014 |

OTHER PUBLICATIONS

International Search Report dated Nov. 2, 2020 issued in PCT Application No. PCT/KR2020/016031.
Japanese Office Action dated Sep. 19, 2023 issued in Application No. 2022-547715.
Extended European Search Report dated Jan. 8, 2024 issued in Application No. 20917395.4.

* cited by examiner

[Fig. 1]

AIR CONDITIONER

CROSS-REFERENCE TO RELATED PATENT APPLICATIONS

This application is a U.S. National Stage Application under 35 U.S.C. § 371 of PCT Application No. PCT/KR2020/016031, filed Nov. 13, 2020, which claims priority to Korean Patent Application No. 10-2020-0014462, filed Feb. 6, 2020, whose entire disclosures are hereby incorporated by reference.

TECHNICAL FIELD

The present disclosure relates to an air conditioner.

BACKGROUND ART

An air conditioner is an apparatus for keeping air in a predetermined space in a most suitable state according to use and purpose. In general, the air conditioner includes a compressor, a condenser, an expansion device, and an evaporator, and a cooling cycle that performs compression, condensation, expansion, and evaporation of a refrigerant is driven to cool or heat a predetermined space.

The predetermined space may be variously proposed depending on a place where the air conditioner is used. For example, the predetermined space may be a home or office.

When the air conditioner performs a cooling operation, an outdoor heat exchanger provided in an outdoor unit functions as a condenser and an indoor heat exchanger provided in an indoor unit functions as an evaporator. On the other hand, when the air conditioner performs a heating operation, the indoor heat exchanger functions as a condenser and the outdoor heat exchanger functions as an evaporator.

Recently, there is a tendency to limit the type of a refrigerant used in the air conditioner and reduce the amount of the refrigerant used according to the environmental regulation policy.

In order to reduce the amount of a refrigerant used, a technique of performing cooling or heating operation by performing heat exchange between a refrigerant and a predetermined fluid has been proposed. In one example, the predetermined fluid may include water.

In relation to a system that performs cooling or heating operation through heat exchange between a refrigerant and water, the following prior art document is disclosed.

1. Japanese Patent Registration No. 5279919
2. Title of the invention: Air conditioner The prior art literature includes an outdoor unit, a heat medium converter, and an indoor unit.

The heat medium converter includes a heat exchanger between heat mediums, a tightening device positioned at an upstream side of the heat exchanger, and a refrigerant flow path changing device positioned at a downstream side of the heat exchanger.

The refrigerant flow path changing device is connected to a refrigerant pipe through which a refrigerant in a low temperature state flows during a cooling operation.

According to the prior art literature, in a case where some of a plurality of heat exchangers are used during the cooling operation, when leakage of a refrigerant occurs in a tightening device positioned at the upstream side of an unused heat exchanger, it is possible to allow a refrigerant to flow along the refrigerant pipe, thus causing a refrigerant to flow in the heat exchanger. In this case, a problem occurs in that water is frozen in a flow path through which water flows in the heat exchanger.

DISCLOSURE OF INVENTION

Technical Problem

The present embodiment provides an air conditioner capable of preventing freezing and breaking of a heat exchanger by restricting flow of a low-temperature refrigerant to the heat exchanger during a defrost operation or an oil recovery operation.

Alternatively or additionally, the present embodiment provides an air conditioner capable of preventing freezing and breaking of a heat exchanger by restricting flow of a low-temperature refrigerant to the heat exchanger even during a pump-down operation for recovering the refrigerant by the outdoor unit.

Solution to Problem

According to an aspect, an air conditioner includes an outdoor unit in which a refrigerant circulates; an indoor unit in which water circulates; a heat exchange device including a heat exchanger that connects the outdoor unit to the indoor unit and performs heat exchange between the refrigerant and the water; a first outdoor unit connection pipe configured to connect the outdoor unit and the heat exchange device, a high-pressure gaseous refrigerant flowing in the first outdoor unit connection pipe; a second outdoor unit connection pipe configured to connect the outdoor unit and the heat exchange device, a low-pressure gaseous refrigerant flowing in the second outdoor unit connection pipe; a third outdoor unit connection pipe configured to connect the outdoor unit and the heat exchange device, a liquid refrigerant flowing in the third outdoor unit connection pipe; a bypass pipe configured to communicate the third outdoor unit connection pipe and the second outdoor unit connection pipe; and a bypass valve provided in the bypass pipe.

The heat exchange device may further include a temperature sensor configured to detect an inlet temperature or an outlet temperature of the heat exchanger. The bypass valve may be opened when the temperature detected by the temperature sensor is lower than or equal to a reference temperature.

The bypass valve may be opened during one of a defrost operation for defrosting an outdoor heat exchanger provided in the outdoor unit, an oil recovery operation for recovering oil by a compressor provided in the outdoor unit, and a pump-down operation for recovering a refrigerant by the outdoor unit.

The bypass valve may be opened when the temperature detected by the temperature sensor is lower than or equal to the reference temperature during one of the defrost operation, the oil recovery operation and the pump-down operation.

The heat exchange device may include a first pipe connected to the first outdoor unit connection pipe; a first valve provided in the first pipe; a third pipe connected to the second outdoor unit connection pipe; a second valve provided in the third pipe; a refrigerant pipe connected to the third outdoor unit connection pipe; and an expansion valve provided in the refrigerant pipe.

The bypass pipe may be connected to the second outdoor unit connection pipe or the third pipe.

The temperature sensor may be disposed between the expansion valve in the refrigerant pipe and the heat exchanger. Alternatively, the temperature sensor may be disposed in the heat exchanger and positioned adjacent to the expansion valve.

The first valve and the bypass valve may be closed, and the second valve and the expansion valve may be opened when the temperature detected by the temperature sensor is higher than the reference temperature.

The bypass valve may be opened and the second valve and the expansion valve may be closed when the temperature detected by the temperature sensor is lower than or equal to the reference temperature.

The outdoor unit may further include an outdoor unit valve configured to adjust flow of refrigerant in the third outdoor unit connection pipe. The outdoor unit valve may be opened during the defrost operation or the oil recovery operation, and the outdoor unit valve may be closed during the pump-down operation.

The bypass valve may be closed when the defrost operation, the oil recovery operation, or the pump-down operation is terminated after the bypass valve is opened.

Alternatively, the bypass valve may be opened immediately when one of the defrost operation, the oil recovery operation, and the pump-down operation is started.

Alternatively, the bypass valve may be opened when a set time has elapsed after one of the defrost operation, the oil recovery operation, and the pump-down operation is started.

Advantageous Effects of Invention

According to the present embodiment, it is possible to prevent freezing and breaking of the heat exchanger by restricting the flow of a low-temperature refrigerant to the heat exchanger during a defrost operation or an oil recovery operation.

According to the present embodiment, it is possible to prevent freezing and breaking of the heat exchanger by restricting the flow of the low-temperature refrigerant to the heat exchanger even during a pump-down operation for recovering the refrigerant by the outdoor unit.

MODE FOR THE INVENTION

Figure 1:
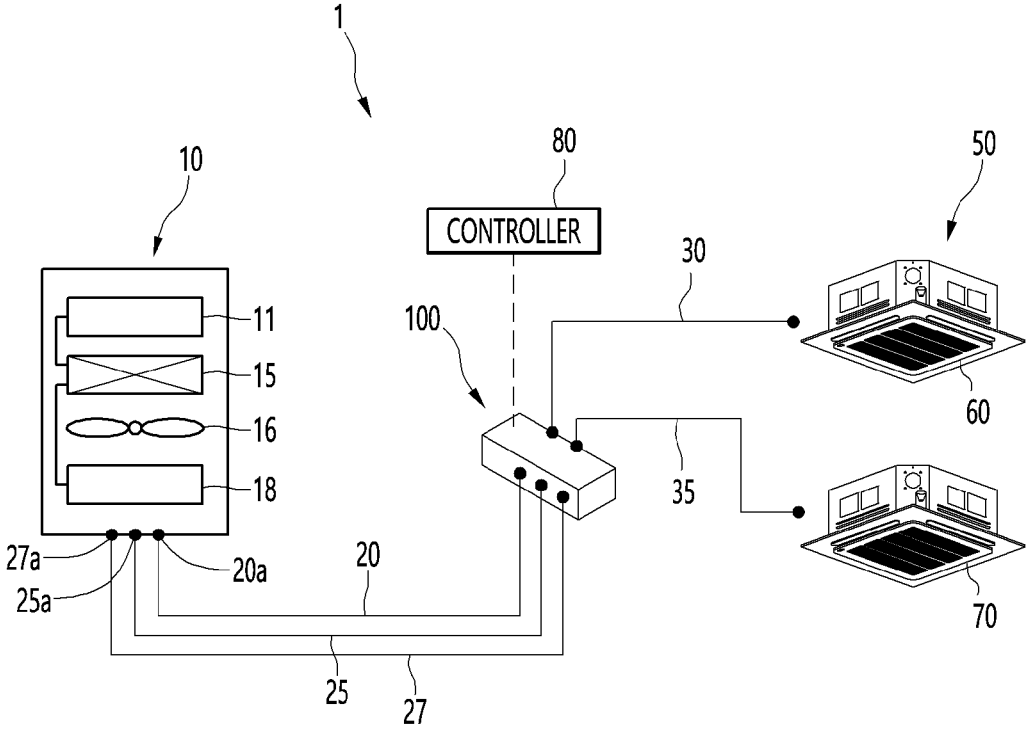
FIG. 1 is a schematic view showing a configuration of an air conditioner according to an embodiment of the present disclosure.

Hereinafter, some embodiments of the present disclosure will be described in detail with reference to accompanying drawings. In the following description, the same reference numerals will be assigned to the same elements even though the elements are illustrated in different drawings. In addition, in the following description of an embodiment of the present disclosure, a detailed description of well-known features or functions will be ruled out in order not to unnecessarily obscure the gist of the present disclosure.

In the following description of elements according to an embodiment of the present disclosure, the terms 'first', 'second', 'A', 'B', '(a)', and '(b)' may be used. The terms are used only to distinguish relevant elements from other elements, and the nature, the order, or the sequence of the relevant elements is not limited to the terms. When a certain element is liked to, coupled to, or connected with another element, the certain element may be directly linked to or connected with the another element, and a third element may be linked, coupled, or connected between the certain element and the another element.

Figure 2:
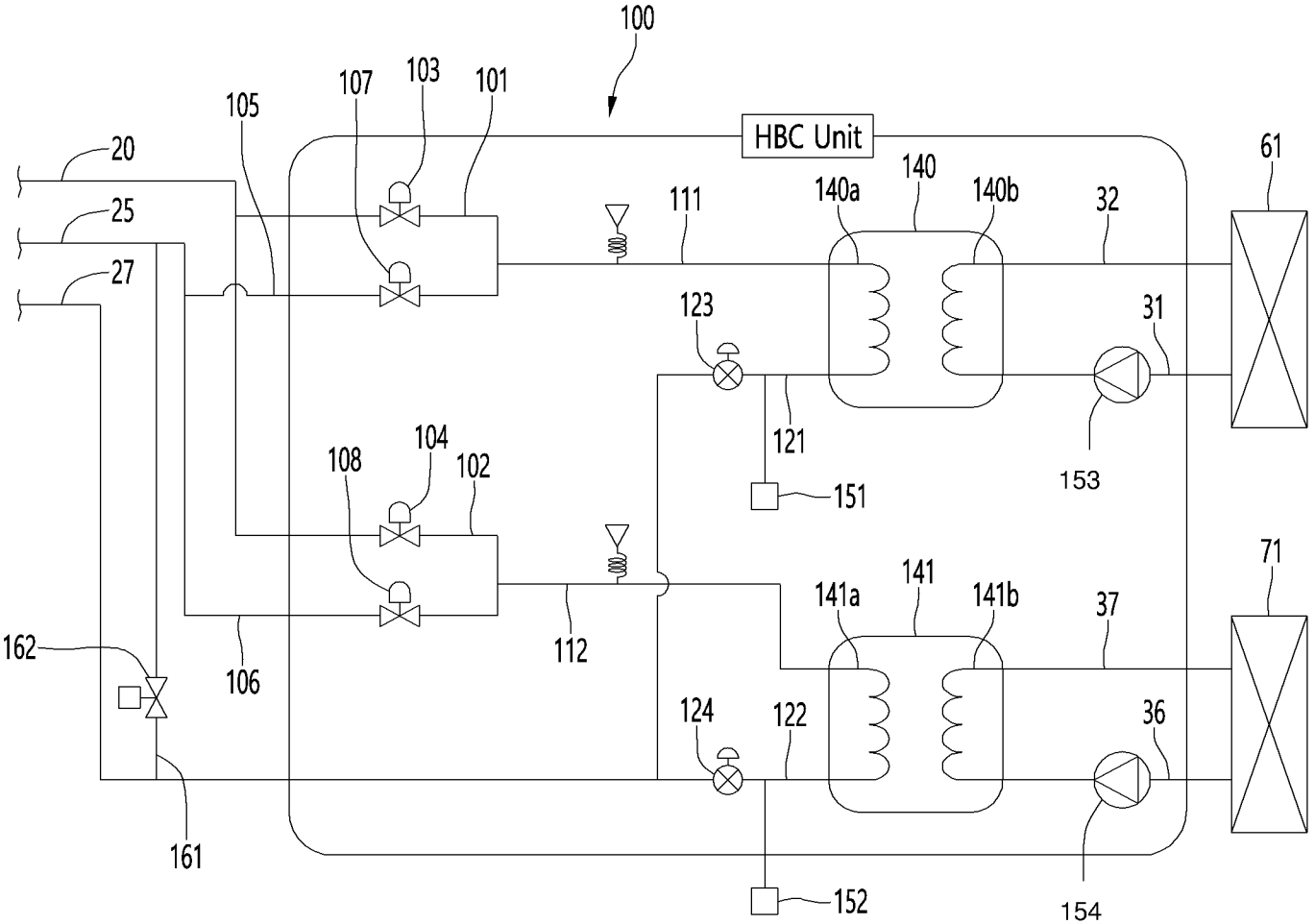
FIG. 2 is a cycle diagram showing a configuration of an air conditioner according to an embodiment of the present disclosure.

FIG. 1 is a schematic view showing a configuration of an air conditioner according to an embodiment of the present disclosure and FIG. 2 is a cycle diagram showing a configuration of an air conditioner according to an embodiment of the present disclosure.

Referring to FIGS. 1 and 2, an air conditioner 1 according to an embodiment of the present disclosure may include an outdoor unit 10, an indoor unit 50, and a heat exchange device 100 connected to the outdoor unit 10 and the indoor unit 50.

The outdoor unit 10 and the heat exchange device 100 may be fluidly connected by a first fluid. In one example, the first fluid may include a refrigerant.

The refrigerant may flow through a refrigerant-side flow path of a heat exchanger provided in the heat exchange device 100 and the outdoor unit 10.

The outdoor unit 10 may include a compressor 11 and an outdoor heat exchanger 15.

An outdoor fan 16 is provided at one side of the outdoor heat exchanger 15 to blow outside air toward the outdoor heat exchanger 15, and heat exchange may be made between the outside air and the refrigerant in the outdoor heat exchanger 15 by the operation of the outdoor fan 16. The outdoor unit 10 may further include a main expansion valve 18 (EEV).

The air conditioner 1 may further include connection pipes 20, 25 and 27 connecting the outdoor unit 10 and the heat exchange device 100.

The connection pipes 20, 25, and 27 may include a first outdoor unit connection pipe 20 as a pipe (high pressure pipes) through which a high-pressure gaseous refrigerant flows, a second outdoor unit connection pipe 25 as a pipe (low pressure pipe) through which a low-pressure gaseous refrigerant flows, and a third outdoor unit connection pipe 27 as a liquid pipe through which a liquid refrigerant flows.

That is, the outdoor unit 10 and the heat exchange device 100 have a "three-pipe connection structure", and the refrigerant may circulated through the outdoor unit 10 and the heat exchange device 100 by the three connection pipes 20, 25, and 27.

The outdoor unit 10 may include a first outdoor unit valve 20*a* for adjusting flow of a refrigerant through a first outdoor unit connection pipe 20, a second outdoor unit valve 25*a* for adjusting flow of a refrigerant through a second outdoor unit connection pipe 25, and a third outdoor unit valve 27*a* for adjusting flow of a refrigerant through a third outdoor unit connection pipe 27.

The heat exchange device 100 and the indoor unit 50 may be fluidly connected by a second fluid. In one example, the second fluid may include water.

Water may flow through a water flow path of a heat exchanger provided in the heat exchange device 100 and the indoor unit 50.

The heat exchange device 100 may include one or more heat exchangers 140 and 141. The heat exchanger may include, for example, a plate shaped heat exchanger.

The heat exchange device 100 may include one or more heat exchangers 140 and 141 according to the number of the indoor units 50.

The indoor unit 50 may include a plurality of indoor units 60 and 70. In the present embodiment, it should be noted that the number of the plurality of indoor units 60 and 70 is not limited, and it is illustrated in FIG. 1 that for example, two indoor units 60 and 70 are connected to the heat exchange device 100.

The plurality of indoor units 60 and 70 may include a first indoor unit 60 and a second indoor unit 70.

The air conditioner 1 may further include pipes 30 and 35 connecting the heat exchange device 100 and the indoor unit 50.

The pipes 30 and 35 may include a first indoor unit connection pipe 30 and a second indoor unit connection pipe 35 that connect the heat exchange device 100 and the indoor units 60 and 70, respectively.

Water may circulate through the heat exchange device 100 and the indoor unit 50 through the indoor unit connection pipes 30 and 35.

Of course, when the number of indoor units increases, the number of pipes connecting the heat exchange device 100 and the indoor units will increase.

According to this configuration, a refrigerant circulating through the outdoor unit 10 and the heat exchange device 100, and water circulating through the heat exchange device 100 and the indoor unit 50 may be heat-exchanged through heat exchangers 140 and 141 provided in the heat exchange device 100.

Water cooled or heated through heat exchange may heat-exchange with the indoor heat exchangers 61 and 71 provided in the indoor unit 50 to perform cooling or heating of an indoor space.

The plurality of heat exchangers 140 and 141 may be provided in the same number as the number of the plurality of the indoor units 60 and 70. Alternatively, two or more indoor units may be connected to one heat exchanger.

Hereinafter, the heat exchange device 100 will be described in detail.

The heat exchange device 100 may be controlled by a controller 80. That is, various valves provided in the heat exchange device 100 may be controlled by the controller 80.

The heat exchange device 100 may include first and second heat exchangers 140 and 141 fluidly connected to the indoor units 70 and 60.

The first and second heat exchangers 140 and 141 may be formed in the same structure.

Each of the heat exchangers 140 and 141 may include, for example, a plate shaped heat exchanger, and may be configured in such manner that water flow paths and refrigerant flow paths are alternately stacked. It should be noted that there is no limitation on the arrangement of the water flow path and the refrigerant flow path in each of the heat exchangers 140 and 141.

Each of the heat exchangers 140 and 141 may include refrigerant flow paths 140*a* and 141*a* and water flow paths 140*b* and 141*b*.

The refrigerant flow paths 140*a* and 141*a* may be fluidly connected to the outdoor unit 10. The refrigerant discharged from the outdoor unit 10 may be introduced to the refrigerant flow paths 140*a* and 141*a* and the refrigerant has passed through the refrigerant flow paths 140*a* and 141*a* may be introduced to the outdoor unit 10.

The water flow paths 140*b* and 141*b* may be fluidly connected to the indoor units 60 and 70, respectively. Water discharged from the indoor units 60 and 70 may be introduced into the water flow paths 140*b* and 141*a*, and the water which has passed through the flow paths 140*b* and 141*a* may be introduced into the indoor units 60 and 70.

The heat exchange device 100 may include a first branch pipe 101 (or a first pipe) and a second branch pipe 102 (or a second pipe) which have branched from the first outdoor unit connection pipe 20.

For example, a high-pressure refrigerant may flow through the first branch pipe 101 and the second branch pipe 102. Accordingly, the first branch pipe 101 and the second branch pipe 102 may be referred to as high pressure pipes.

First valves 103 and 104 may be provided in the first branch pipe 101*a* and the second branch pipe 102*a*, respectively. In the present specification, it should be noted that there is no limit in the number of branch pipes branching from the first outdoor unit connection pipe 20.

The heat exchange device 100 may include a third branch pipe 105 (or a third pipe) and a fourth branch pipe 106 (or a fourth pipe) which have branched from the second outdoor unit connection pipe 25.

For example, a low-pressure refrigerant may flow through the third branch pipe 105 and the fourth branch pipe 106. Accordingly, the third branch pipe 105 and the fourth branch pipe 106 may be referred to as low pressure pipes, for example.

Second valves 107 and 108 may be provided in the third branch pipe 105 and the fourth branch pipe 106, respectively. In the present specification, it should be noted that there is no limit in the number of branch pipes branching from the second outdoor unit connection pipe 25.

The heat exchange device 100 may include a first common gas pipe 111 to which the first branch pipe 101 and the third branch pipe 105 are connected and a second common gas pipe 112 to which the second branch pipe 102 and the fourth branch pipe 106 are connected.

The first common gas pipe 111 may be connected to one end of the refrigerant flow path 140*a* of the first heat exchanger 140. The second common gas pipe 112 may be connected to one end of the refrigerant flow path 141*a* of the second heat exchanger 141.

Refrigerant pipes 121 and 122 may be connected to the other ends of the refrigerant flow paths 140*a* and 141*a* of the heat exchangers 140 and 141.

A first refrigerant pipe 121 may be connected to the first heat exchanger 140 and a second refrigerant pipe 122 may be connected to the second heat exchanger 141.

A first expansion valve 123 may be provided in the first refrigerant pipe 121, and a second expansion valve 124 may be provided in the second refrigerant pipe 122.

The first refrigerant pipe 121 and the second first refrigerant pipe 122 may be connected to a third outdoor unit connection pipe 27.

Each of the expansion valves 123 and 124 may include, for example, an electronic expansion valve (EEV).

The electronic expansion valve may drop the pressure of a refrigerant passing through the expansion valve through control of an opening degree. As one example, when the expansion valve is fully opened (in a full-open state), a refrigerant may pass through without reduction in pressure, and when the opening degree of the expansion valve is reduced, the refrigerant may be depressurized. The degree of pressure reduction of the refrigerant increases as the opening degree decreases.

The heat exchange device 100 may further include temperature sensors 151 and 152, each of which detects a temperature of a refrigerant flowing through each of the heat exchangers 140 and 141.

Each of the temperature sensors 151 and 152 may, for example, detect a temperature of a refrigerant that is expanded in each of the expansion valves 123 and 124 and introduced into each of the heat exchangers 140 and 141. That is, each of the temperature sensors 151 and 152 may detect an inlet temperature of each of the heat exchangers 140 and 141 based on a cooling operation.

The temperature sensors 151 and 152 may be respectively disposed between the expansion valves 123 and 124 and the refrigerant flow paths 140*a* and 141*a* of the heat exchangers 140 and 141 in the refrigerant pipes 121 and 122. Alternatively, each of the temperature sensors 151 and 152 may be disposed in the refrigerant flow paths 140*a* and 141*a*. In this case, the temperature sensors 151 and 152 may be disposed adjacent to the expansion valves 123 and 124.

The heat exchange device 100 may further include a bypass pipe 161 for communicating the third outdoor unit connection pipe 27 and the second outdoor unit connection pipe 25.

The bypass pipe 161 may serve to guide a refrigerant of the third outdoor unit connection pipe 27 toward the second outdoor unit connection pipe 25.

The bypass pipe 161 may bypass a refrigerant flowing through the third outdoor unit connection pipe 27 to flow to the second outdoor unit connection pipe 25 without passing through each of the heat exchangers 140 and 141.

The bypass pipe 161 may be connected to the second outdoor unit connection pipe 25 or to the third branch pipe 105 or the fourth branch pipe 106, for example.

A bypass valve 162 may be provided in the bypass pipe 161. The bypass valve 162 may be a valve that simply controls the flow of a refrigerant or a pressure reducing valve that reduces a pressure.

Meanwhile, the indoor unit connection pipes 30 and 35 may include heat exchanger inlet pipes 31 and 36 and heat exchanger outlet pipes 32 and 37, respectively.

Pumps 153 and 154 may be provided in the heat exchanger inlet pipes 31 and 36, respectively.

The heat exchanger inlet pipes 31 and 36 and the heat exchanger outlet pipes 32 and 37 may be connected to the indoor heat exchangers 61 and 71, respectively.

The heat exchanger inlet pipes 31 and 36 may function as indoor unit discharge pipes with respect to the indoor heat exchanger 61 and 71, and the heat exchanger outlet pipes 32 and 37 may function as indoor unit inlet pipes with respect to the indoor heat exchangers 61 and 71.

Figure 3:
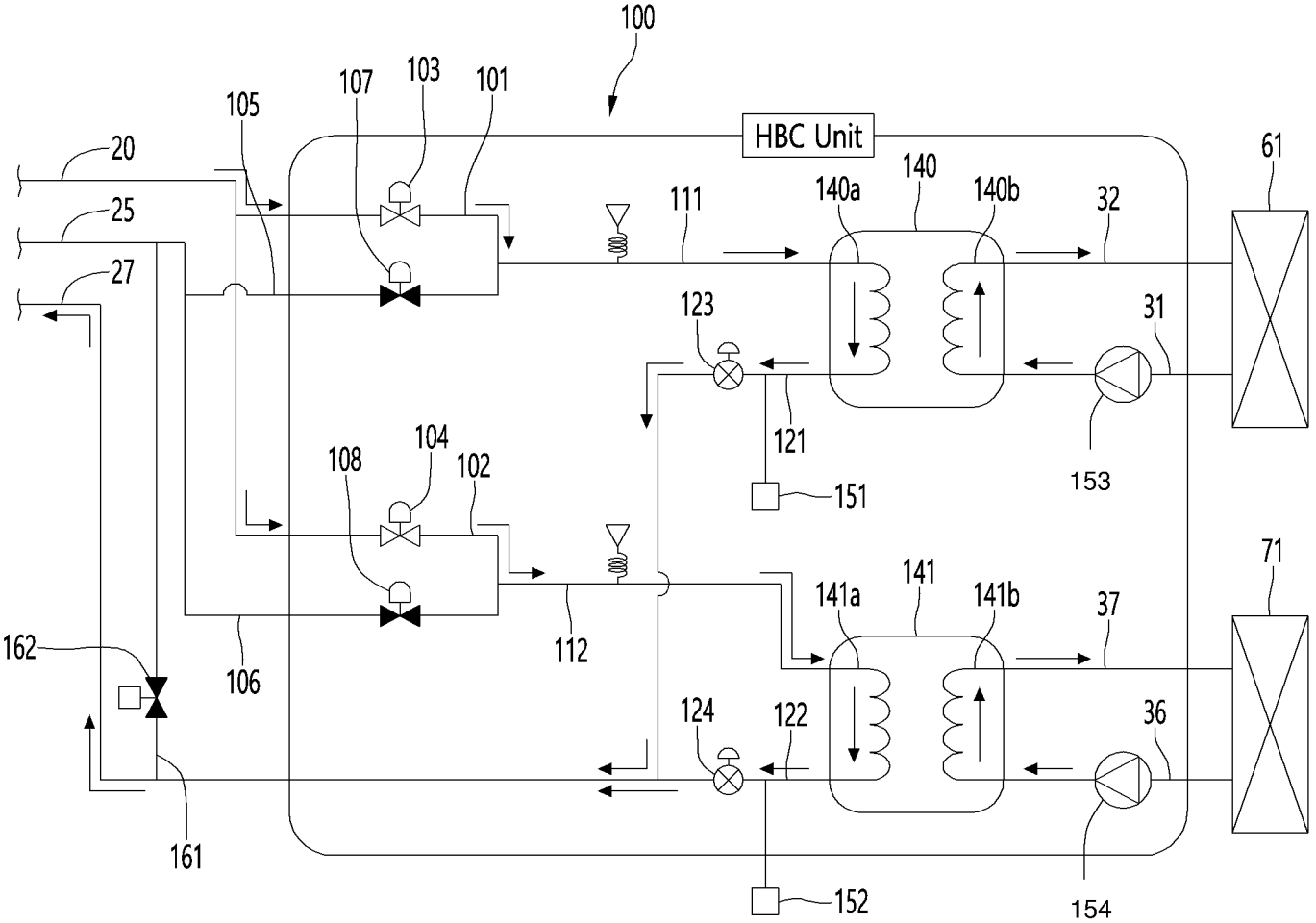
FIG. 3 is a cycle diagram showing flow of a refrigerant and water in a heat exchange device during a heating operation of an air conditioner according to an embodiment of the present disclosure.

FIG. 3 is a cycle diagram showing flow of a refrigerant and water in a heat exchange device during a heating operation of an air conditioner according to an embodiment of the present disclosure.

Referring to FIGS. 1 and 3, when the air conditioner 1 is operated in a heating operation mode (when a plurality of indoor units are operated in a heating operation mode), the high-pressure gaseous refrigerant compressed in the compressor 11 of the outdoor unit 10 flows through the first outdoor unit connection pipe 20 and is then distributed to the first branch pipe 101 and the second branch pipe 102.

During a heating operation of the air conditioner 1, the first outdoor unit valve 20*a* and the third outdoor unit valve 27*a* may be opened, and the second outdoor unit valve 25*a* may be closed.

During the heating operation of the air conditioner 1, the first valves 103 and 104 of the first and second branch pipes 101 and 102 may be opened, and the second valves 107 and 108 of the third and fourth branch pipes 105 and 106 may be closed. In addition, the bypass valve 162 may be closed.

The refrigerant distributed to the first branch pipe 101 may flow along the first common gas pipe 111 and then flow to the refrigerant flow path 140*a* of the first heat exchanger 140. The refrigerant distributed to the second branch pipe 102 may flow along the second common gas pipe 112 and then flow to the refrigerant flow path 141*a* of the second heat exchanger 141.

In the present embodiment, during the heating operation of the air conditioner 1, the heat exchangers 140 and 141 may function as a condenser.

During the heating operation of the air conditioner 1, the first expansion valve 123 and the second expansion valve 124 may be opened. For example, each of the expansion valves 123 and 124 may be fully opened.

The refrigerant passing through the refrigerant flow paths 140*a* and 141*a* of the heat exchangers 140 and 141 may flow into the third outdoor unit connection pipe 27 after passing through the expansion valves 123 and 124.

The refrigerant which has flowed to the third outdoor unit connection pipe 27 may be introduced into the outdoor unit 10 and may be sucked into the compressor 11. The high-pressure refrigerant compressed by the compressor 11 may flow back to the heat exchange device 100 through the first outdoor unit connection pipe 20.

On the other hand, water flowing through the water flow paths 140*b* ad 141*b* of the heat exchangers 140 and 141 may be heated by heat exchange with refrigerant, and the heated water may be supplied to the indoor heat exchangers 61 and 71 to perform heating.

Figure 4:
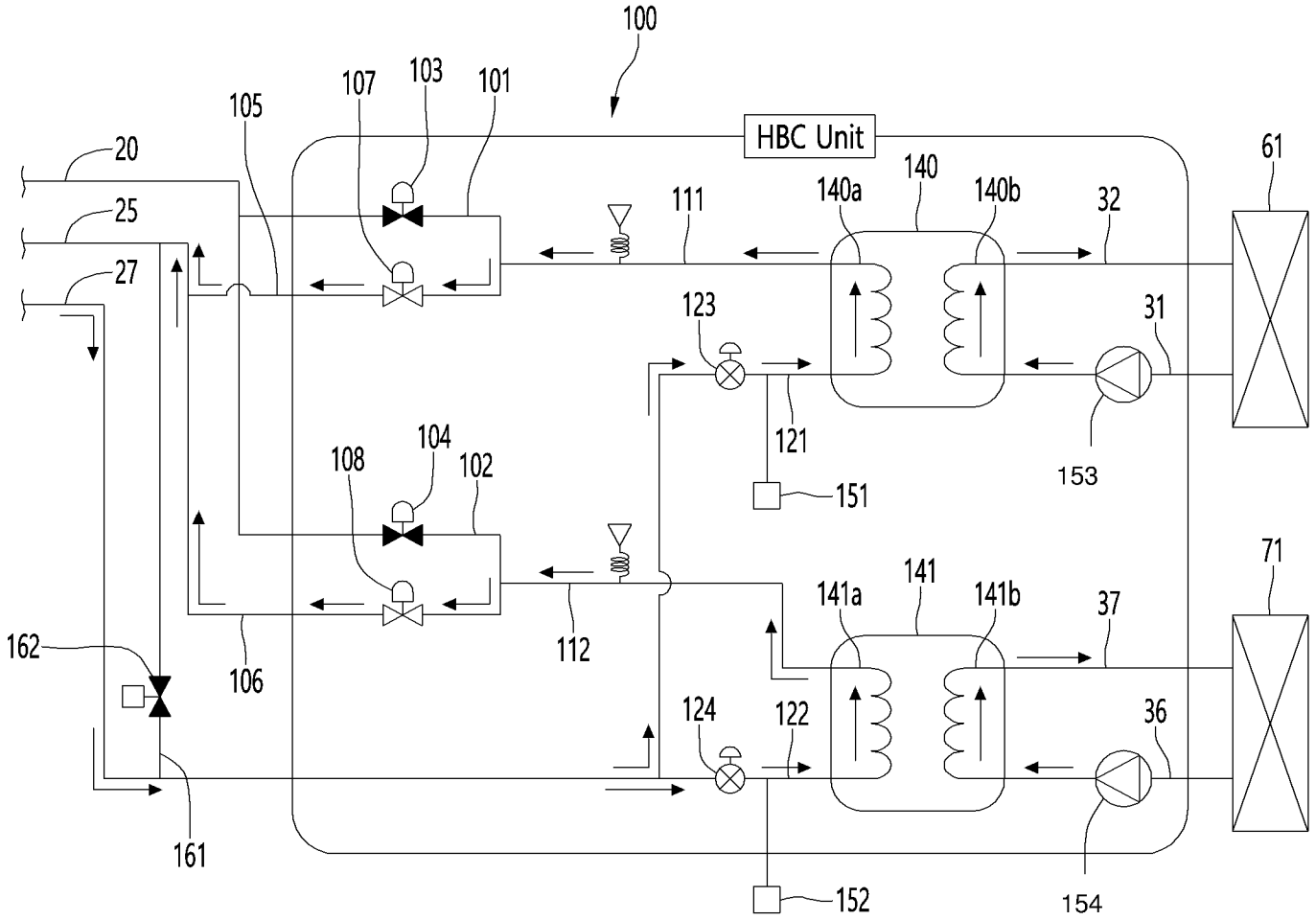
FIG. 4 is a cycle diagram showing flow of a refrigerant and water in a heat exchange device during a cooling operation of an air conditioner according to an embodiment of the present disclosure.

FIG. 4 is a cycle diagram showing flow of refrigerant and water in a heat exchange device during a cooling operation of an air conditioner according to an embodiment of the present disclosure.

Referring to FIG. 4, when the air conditioner 1 is operated in a cooling operation mode (when a plurality of indoor units are operated in a cooling operation mode), the high-pressure gaseous refrigerant compressed by the compressor 11 of the outdoor unit 10 may flow to the outdoor heat exchanger 15. The high-pressure liquid refrigerant condensed in the outdoor heat exchanger 15 may be distributed to the first refrigerant pipe 121 and the second cold exhaust pipe 122 after flowing through the third outdoor unit connection pipe 27.

During a cooling operation of the air conditioner 1, the second outdoor unit valve 25*a* and the third outdoor unit valve 27*a* may be opened, and the first outdoor unit valve 20*a* may be closed.

When the air conditioner 1 is being operated in the cooling operation mode, the first valves 103 and 104 of the first and second branch pipes 101 and 102 may be closed and the second valves 107 and 108 of the third and fourth branch pipes 105 and 106 may be opened. In addition, the bypass valve 162 may be closed.

The expansion valves 123 and 124 provided in the first and second refrigerant pipes 121 and 122 may be opened with a predetermined opening degree. Accordingly, the refrigerant may be de-pressurized to be a low-pressure refrigerant while passing through the expansion valves 123 and 124.

The refrigerant of which a pressure is reduced may be evaporated through heat exchange with water while flowing along the refrigerant flow paths 140*a* and 141*a* of the heat exchangers 140 and 141. That is, during the cooling operation of the air conditioner 1, the heat exchangers 140 and 141 may function as evaporators.

Therefore, the refrigerant that has passed through the refrigerant flow paths 140*a* and 141*a* of the heat exchangers 140 and 141 may flow to the common gas pipes 111 and The refrigerant which has flowed into the common gas pipes 111 and 112 may flow to the third and fourth branch pipes 105 and 106 and then to the second outdoor unit connection pipe 25.

The refrigerant which has flowed to the second outdoor unit connection pipe 25 may be introduced into the outdoor unit 10 and sucked into the compressor 11. The high-pressure refrigerant compressed by the compressor 11 may be condensed in the outdoor heat exchanger 15, and the condensed liquid refrigerant may flow along the third outdoor unit connection pipe 27 again.

Meanwhile, during the heating operation of the air conditioner, the outdoor heat exchanger 15 of the outdoor unit 10 may function as an evaporator. When the outdoor heat exchanger 15 functions as an evaporator in a state where an outdoor temperature is low, frost may be formed on the outdoor heat exchanger 15 and when the amount of frost formation increases, the outdoor heat exchanger 15 may need to be defrosted. When the outdoor heat exchanger 15 needs to be defrosted during the heating operation of the air conditioner, the air conditioner may be operated in a defrost operation mode.

The refrigerant flow during the defrost operation of the air conditioner is basically the same as the refrigerant flow during the cooling operation of the air conditioner.

Figure 5:
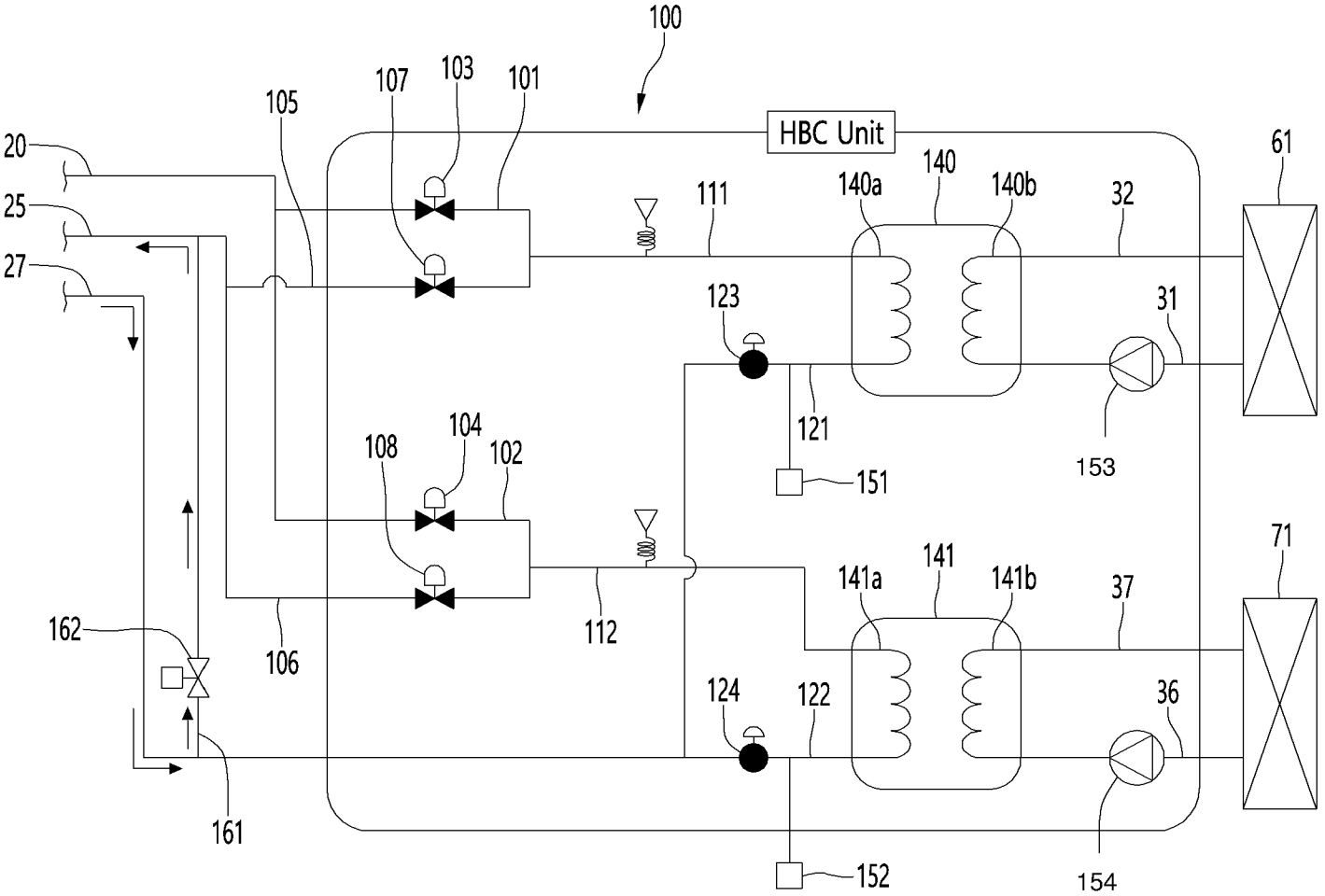
FIG. 5 is a cycle diagram showing flow of a refrigerant and water in a heat exchange device during a defrost operation of an air conditioner according to an embodiment of the present disclosure.

FIG. 5 is a cycle diagram showing flow of a refrigerant and water in a heat exchange device during a defrost operation of an air conditioner according to an embodiment of the present disclosure.

Referring to FIG. 5, when the air conditioner may be operated in a defrost operation mode, the second outdoor unit valve 25*a* and the third outdoor unit valve 27*a* may be opened, and the first outdoor unit valve 20*a* may be closed.

When the air conditioner 1 is being operated in the defrost operation mode, the first valves 103 and 104 of the first and second branch pipes 101 and 102 may be closed and the second valves 107 and 108 of the third and fourth branch pipes 105 and 106 may be opened. In addition, the bypass valve 162 may be closed.

When the air conditioner 1 is operated in defrost operation mode, the high-temperature gaseous refrigerant compressed by the compressor 11 of the outdoor unit 10 may flow to the outdoor heat exchanger 15. Defrosting may be performed on the outdoor heat exchanger 15 while a high-temperature gaseous refrigerant is flowing through the outdoor heat exchanger 15.

The high-pressure liquid refrigerant condensed in the outdoor heat exchanger 15 may be distributed to the first refrigerant pipe 121 and the second cold exhaust pipe 122 after flowing through the third outdoor unit connection pipe 27.

During the defrost operation of the air conditioner 1, the expansion valves 123 and 124 provided in the first and second refrigerant pipes 121 and 122 may be opened with a predetermined opening degree. Accordingly, the refrigerant may be de-pressurized to be a low-pressure refrigerant while passing through the expansion valves 123 and 124. The de-pressurized refrigerant may be evaporated through heat exchange with water while flowing along the refrigerant flow paths 140*a* and 141*a* of the heat exchangers 140 and 141.

Since the refrigerant introduced to the heat exchangers 140 and 141 is in a low-temperature state, water in the water flow paths 140 and 141 of the heat exchangers 140 and 141 is likely to be frozen when a low-temperature refrigerant flows through the refrigerant flow paths 140*a* and 141*a* of the heat exchangers 140 and 141. When the water in the water flow paths 140*b* and 141*b* has frozen, there is a concern that the heat exchangers 140 and 141 are damaged.

Since the defrost operation is substantially performed by switching from the heating operation to the cooling operation, the defrost operation needs to be quickly performed so as to minimize the deterioration of indoor comfort. Accordingly, an operating frequency of the compressor 11 during the defrost operation is greater than an operating frequency of the compressor during the heating operation.

When the operating frequency of the compressor 11 is high, the low pressure of the cycle is reduced, and accordingly, a temperature of a refrigerant introduced into the heat exchangers 140 and 141 that function as evaporators is low.

Therefore, the controller 80 may restrict the flow of a refrigerant to the heat exchangers 140 and 141 when a temperature detected by the temperature sensors 151 and 152 is lower than or equal to a reference temperature to prevent freezing and breaking of the heat exchangers 140 and 141 during the defrost operation of the air conditioner 1.

To restrict the flow of a refrigerant to the heat exchangers 140 and 141, the controller 80 may open the bypass valve 162. When the bypass valve 162 is opened, the refrigerant in the third outdoor unit connection pipe 27 is bypassed to the second outdoor unit connection pipe 25, so that the refrigerant in the third outdoor unit connection pipe 27 may be restricted from flowing to the heat exchanger 140 and 141.

Preferably, the controller 80 may close the expansion valves 123 and 124 when the bypass valve 162 is opened so as to prevent the flow of a refrigerant to the heat exchangers 140 and 141. In addition, the controller 80 may close the second valves 107 and 108 of the third and fourth branch pipes 105 and 106 which are opened.

Then, since all of the refrigerant in the third outdoor unit connection pipe 27 is bypassed to the second outdoor unit connection pipe 25, freezing and breaking of the heat exchangers 140 and 141 may be effectively prevented. Since the first to fourth valves 103, 104, 107, and 108 are closed even when a refrigerant leaks from each of the expansion valves 123 and 124, the refrigerant flow in the heat exchangers 140 and 141 hardly occurs, thus preventing freezing and breaking of the heat exchangers 140 and 141.

In the defrost operation of the air conditioner 1, the controller 80 may close the bypass valve 162 when the defrost operation is completed after the bypass valve 162 is opened. After the defrost operation is completed, it is possible to switch to the heating operation.

As another example, the controller 80 may open the bypass valve 162 immediately and close the expansion valves 123 and 124 and the second valves 107 and 108 when the defrost operation is started. Alternatively, the controller 80 may open the bypass valve 162 and close the expansion valves 123 and 124 and the second valves 107 and 108 when a set time has elapsed after the defrost operation is started.

Meanwhile, the air conditioner 1 may perform an oil recovery operation for recovering oil existing in the outdoor unit connection pipes 20, 25 and 27 and the pipes of the heat exchanger 100 by the compressor 11. The refrigerant flow and valve control during the oil recovery operation may be the same as the refrigerant flow and valve control during the defrost operation.

It is effective to allow a liquid refrigerant to flow toward the heat exchange device 100 for oil recovery. To this end, the liquid refrigerant may flow to the heat exchange device 100 along the third outdoor unit connection pipe 27. In this case, the liquid refrigerant in the third outdoor unit connection pipe 27 may pass through the expansion valves 123 and 124, and in this process, the refrigerant is depressurized. The refrigerant of which a pressure is reduced may be evaporated through heat exchange with water while flowing along the refrigerant flow paths 140*a* and 141*a* of the heat exchangers 140 and 141.

Since the refrigerant introduced to the heat exchangers 140 and 141 is in a low-temperature state, the heat exchangers 140 and 141 is likely to be frozen when a low-temperature refrigerant flows through the refrigerant flow paths 140*a* and 141*a* of the heat exchangers 140 and 141.

Accordingly, even during the oil recovery operation of the air conditioner 1, the bypass valve 162 may be opened when the temperature detected by the temperature sensors 151 and 152 is lower than or equal to the reference temperature. Additionally, the expansion valves 123 and 124 and the second valves 107 and 108 may be closed.

The air conditioner 1 may perform a pump-down operation to recover the refrigerant by the outdoor unit 10 in order to respond to a service such as pipe leakage or replacement of parts of a heat exchange device. The pump-down operation may be basically the same as the cooling operation, and during the pump-down operation, the bypass valve 162 may be opened based on the temperature detected by the temperature sensors 151 and 152 to prevent the heat exchanger 140 and 141 from freezing and breaking.

During the pump-down operation, the third outdoor unit valve 27*a* may be closed unlike the defrost operation or the oil recovery operation.

According to the present disclosure, since the flow of low-temperature refrigerant to the heat exchanger is restricted during the defrost operation, the oil recovery operation, or the pump-down operation, freezing and breaking of the heat exchanger may be prevented.

The invention claimed is:

1. An air conditioner comprising:

an outdoor unit in which a refrigerant circulates;

an indoor unit in which water circulates;

a heat exchange device including a heat exchanger that is fluidly connected to the outdoor unit and to the indoor unit and performs heat exchange between the refrigerant and the water;

a first outdoor unit connection pipe configured to connect the outdoor unit and the heat exchange device, the refrigerant flowing in a high-pressure gaseous state in the first outdoor unit connection pipe;

a second outdoor unit connection pipe configured to connect the outdoor unit and the heat exchange device, the refrigerant flowing in a low-pressure gaseous state in the second outdoor unit connection pipe;

a third outdoor unit connection pipe configured to connect the outdoor unit and the heat exchange device, the refrigerant flowing in a liquid state in the third outdoor unit connection pipe;

a bypass pipe configured to communicate with the third outdoor unit connection pipe and the second outdoor unit connection pipe; and a bypass valve provided in the bypass pipe, wherein the heat exchange device includes:

a first pipe connected to the first outdoor unit connection pipe;

a first valve provided in the first pipe;

a third pipe connected to the second outdoor unit connection pipe;

a second valve provided in the third pipe;

a refrigerant pipe connected to the third outdoor unit connection pipe; and an expansion valve provided in the refrigerant pipe, wherein the bypass pipe is connected to the second outdoor unit connection pipe or the third pipe.

2. The air conditioner of claim 1, wherein the heat exchange device further includes a temperature sensor configured to detect a temperature at an inlet or an outlet of the heat exchanger, and wherein the bypass valve is opened when the temperature detected by the temperature sensor is lower than or equal to a reference temperature.

3. The air conditioner of claim 2, wherein the temperature sensor is disposed between the expansion valve in the refrigerant pipe and the heat exchanger.

4. The air conditioner of claim 2, wherein the temperature sensor is disposed at the heat exchanger and positioned adjacent to the expansion valve.

5. The air conditioner of claim 2, wherein the first valve and the bypass valve are closed, and the second valve and the expansion valve are opened when the temperature detected by the temperature sensor is higher than the reference temperature.

6. The air conditioner of claim 2, wherein the bypass valve is opened and the second valve and the expansion valve are closed when the temperature detected by the temperature sensor is lower than or equal to the reference temperature.

7. The air conditioner of claim 2, wherein the bypass valve is opened when the temperature detected by the temperature sensor is lower than or equal to the reference temperature during at least one of a defrost operation for defrosting an outdoor heat exchanger provided in the outdoor unit, an oil recovery operation for recovering oil by a compressor provided in the outdoor unit, or a pump-down operation for recovering the refrigerant by the outdoor unit.

8. The air conditioner of claim 7, wherein the outdoor unit further includes an outdoor unit valve configured to adjust a flow of the refrigerant in the third outdoor unit connection pipe, wherein the outdoor unit valve is opened during the defrost operation or the oil recovery operation, and wherein the outdoor unit valve is closed during the pump-down operation.

9. The air conditioner of claim 7, wherein the bypass valve is closed when the defrost operation, the oil recovery operation, or the pump-down operation is terminated after the bypass valve is opened.

10. The air conditioner of claim 1, wherein the bypass valve is opened during one of a defrost operation for defrosting an outdoor heat exchanger provided in the outdoor unit, an oil recovery operation for recovering oil by a compressor provided in the outdoor unit, or a pump-down operation for recovering the refrigerant by the outdoor unit.

11. The air conditioner of claim 10, wherein the bypass valve is opened immediately when one of the defrost operation, the oil recovery operation, or the pump-down operation is started.

12. The air conditioner of claim 10, wherein the bypass valve is opened when a set time has elapsed after one of the defrost operation, the oil recovery operation, and the pump-down operation is started.

13. The air conditioner of claim 10, wherein the heat exchange device includes:

a first pipe connected to the first outdoor unit connection pipe;

a first valve provided in the first pipe;

a third pipe connected to the second outdoor unit connection pipe;

a second valve provided in the third pipe;

a refrigerant pipe connected to the third outdoor unit connection pipe; and an expansion valve provided in the refrigerant pipe, wherein the first valve, the second valve, and the expansion valve are closed when the bypass valve is opened.

14. A method for controlling an air conditioner including an outdoor unit circulating a refrigerant; an indoor unit circulating water; a heat exchange device including a heat exchanger that is fluidly connected to the outdoor unit and to the indoor unit and performs heat exchange between the refrigerant and the water; a first outdoor unit connection pipe configured to connect the outdoor unit and the heat exchange device, the refrigerant flowing in a high-pressure gaseous state in the first outdoor unit connection pipe; a second outdoor unit connection pipe configured to connect the outdoor unit and the heat exchange device, the refrigerant flowing in a low-pressure gaseous state in the second outdoor unit connection pipe; a third outdoor unit connection pipe configured to connect the outdoor unit and the heat exchange device, the refrigerant flowing in a liquid state in the third outdoor unit connection pipe; a bypass pipe configured to communicate with the third outdoor unit connection pipe and the second outdoor unit connection pipe; and a bypass valve provided in the bypass pipe, the method comprising:

determining a temperature of the heat exchanger; and opening the bypass valve when the temperature is lower than or equal to a reference temperature, wherein, when the bypass valve is opened, refrigerant in the third outdoor unit connection pipe flows to the second outdoor unit connection pipe.

15. The method of claim 14, wherein the heat exchange device includes:

a first pipe connected to the first outdoor unit connection pipe;

a first valve provided in the first pipe;

a third pipe connected to the second outdoor unit connection pipe;

a second valve provided in the third pipe;

a refrigerant pipe connected to the third outdoor unit connection pipe; and an expansion valve provided in the refrigerant pipe, and wherein the method further comprises closing the first valve and the bypass valve, and opening the second valve and the expansion valve when the temperature is higher than the reference temperature.

16. The air conditioner of claim 15, wherein method further comprises opening the bypass valve, and closing the second valve and the expansion valve when the temperature is lower than or equal to the reference temperature.

17. The method of claim 14, further comprising:

opening the bypass valve during one of a defrost operation for defrosting an outdoor heat exchanger provided in the outdoor unit, an oil recovery operation for recovering oil by a compressor provided in the outdoor unit, or a pump-down operation for recovering the refrigerant by the outdoor unit.

18. The method of claim 14, wherein the heat exchange device includes:

a first pipe connected to the first outdoor unit connection pipe;

a first valve provided in the first pipe;

a third pipe connected to the second outdoor unit connection pipe;

a second valve provided in the third pipe;

a refrigerant pipe connected to the third outdoor unit connection pipe; and an expansion valve provided in the refrigerant pipe, and wherein the method further comprises closing the first valve, the second valve, and the expansion valve when the bypass valve is opened.

* * * * *